United States Patent [19]

Armstrong

[11] Patent Number: 4,948,144

[45] Date of Patent: Aug. 14, 1990

[54] GAME PLAYING APPARATUS

[76] Inventor: Raymond Armstrong, 12 Reiman Road, Toronto, Ontario, Canada, M5P 2Y5

[21] Appl. No.: 299,579

[22] Filed: Jan. 23, 1989

[51] Int. Cl.[5] ..... A63F 3/00

[52] U.S. Cl. ..... 273/249; 273/272; 273/308

[58] Field of Search ..... 273/276, 308, 243, 249, 273/272

[56] References Cited

U.S. PATENT DOCUMENTS

| | | | |
|---|---|---|---|
| 1,558,229 | 10/1925 | Bowman | 273/308 |
| 3,817,531 | 6/1974 | King et al. | 273/243 |
| 4,029,320 | 6/1977 | Hausman | 273/249 |

*Primary Examiner*—Benjamin Layno

*Attorney, Agent, or Firm*—Rogers, Bereskin & Parr

[57] ABSTRACT

Apparatus for playing a children's game comprises a game board, game cards and a die. The game board includes respective start and finish points linked by a path formed of a chain of discrete spaces. The path includes representations of creatures and their names, portions of each representation and associated name being located in separate spaces. The game cards each carry a portion of a representation of a creature and a portion of its name corresponding to a space of the path. Players use the die to move along the path, attempting to form new or existing creatures or names with the cards in conjunction with the representations and names on the board in the spaces adjacent the space the players land upon.

21 Claims, 2 Drawing Sheets

GAME PLAYING APPARATUS

FIELD OF THE INVENTION

This invention relates to a game, and in particular to a board game for children.

BACKGROUND OF THE INVENTION

The most important aspect of any children's game is that the game is enjoyable. This may be achieved by making the game amusing and competitive. However, many games also serve an important educational function, though this should not detract from the amusement the children will obtain from the game.

SUMMARY OF THE INVENTION

According to one aspect of the present invention, there is provided a game apparatus comprising a playing surface and a set of playing pieces. The playing surface includes a representation of a path extending between a start area and a finish area and is divided into a chain of discrete spaces. Representations of different objects overlie the path and each object extends between respective first and second adjacent spaces such that each object is divided into respective first and second portions. Each playing piece bears, on a front side thereof, a representation of a respective first or second portion of an object corresponding to one of the first or second portions of the playing surface.

The playing surface may include a plurality of words associated with each of the different objects and also overlying the path. Each word extends between the respective first and second spaces such that each object and associated word are divided into respective first and second portions. Each playing piece may bear a representation of respective first or second portions of the object and associated word corresponding to one of the first or second portions on the playing surface.

A game may be played by a plurality of players using the apparatus. Each player selects a first playing piece and a first player begins the game by moving a number of spaces along the path. The number of spaces moved may be determined from a die thrown by the player. If the space the player lands upon contains a first or second portion of an object and the first playing piece bears a first or second portion, respectively, the player has created a new object and is awarded the first playing piece, and may select a second playing piece. The first player then takes another turn, playing with the second playing piece. Alternatively, if the first space contains a first or second portion of an object and the first playing piece bears a second or first portion, respectively, the first player's turn ends. The other players take their turn until a player reaches the finish. The playing pieces held by the players are then totalled to determined the winner.

In a variation of the game, the first player's turn does not necessarily end if the first playing piece lands on a space containing a first or second portion of an object and the first playing piece bears a second or first portion, respectively. If the first player can form a dictionary word by combining the first or second portion of the word on the first playing piece with the first or second portion of a word on a space adjacent the first space, the first playing piece is moved forward one space and the player's turn continues.

The different objects may be creatures, divided into head portions and body portions, and the associated words may be the names of the creatures.

BRIEF DESCRIPTION OF THE DRAWINGS

These and other aspects of the invention will now be described, by way of example, with reference to the accompanying drawings, in which.

DETAILED DESCRIPTION OF PREFERRED EMBODIMENTS

Figure 1:
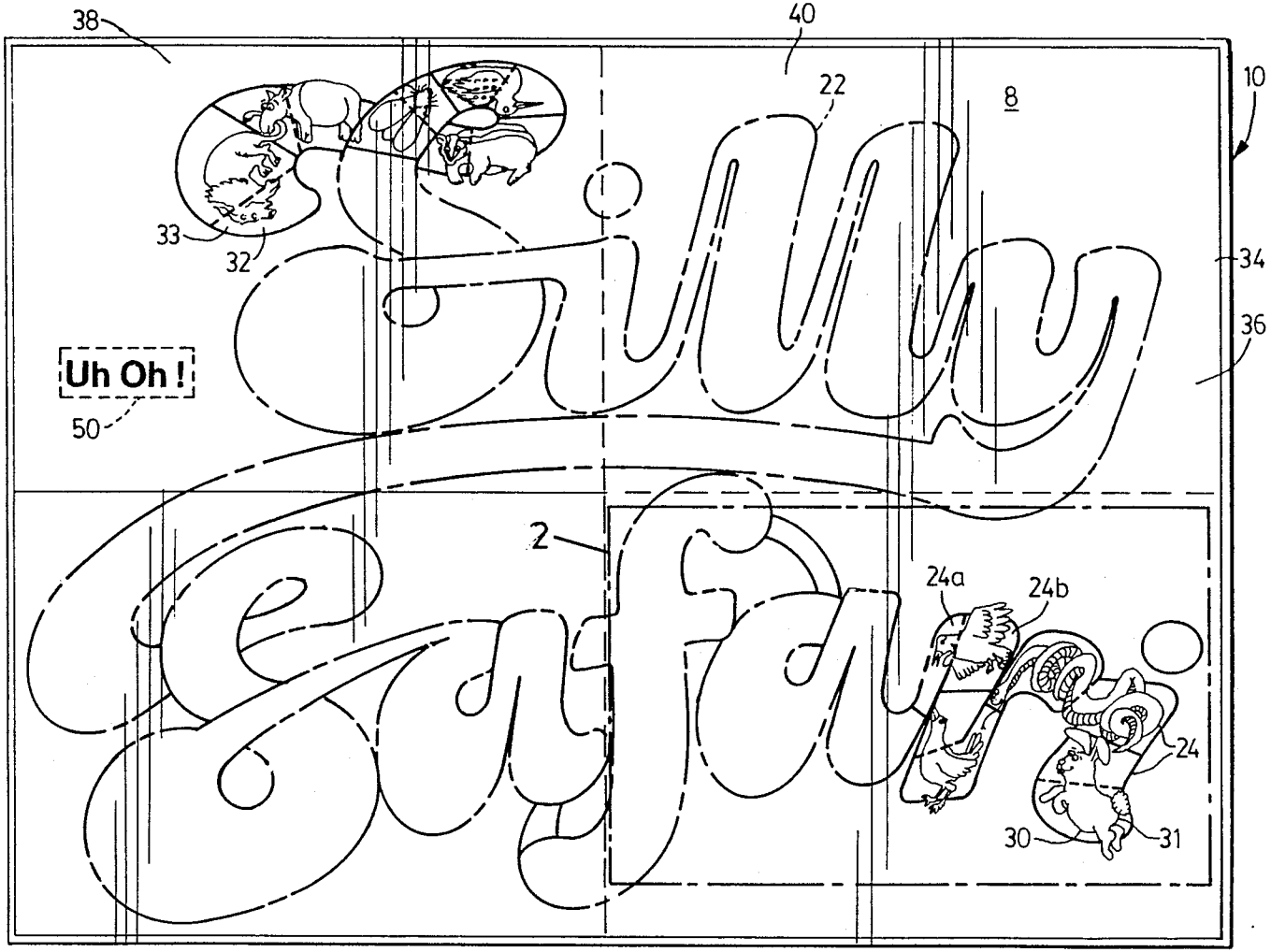
FIG. 1 is a view from above of a game board forming part of a game playing apparatus in accordance with a preferred embodiment of the present invention.
Figure 2:
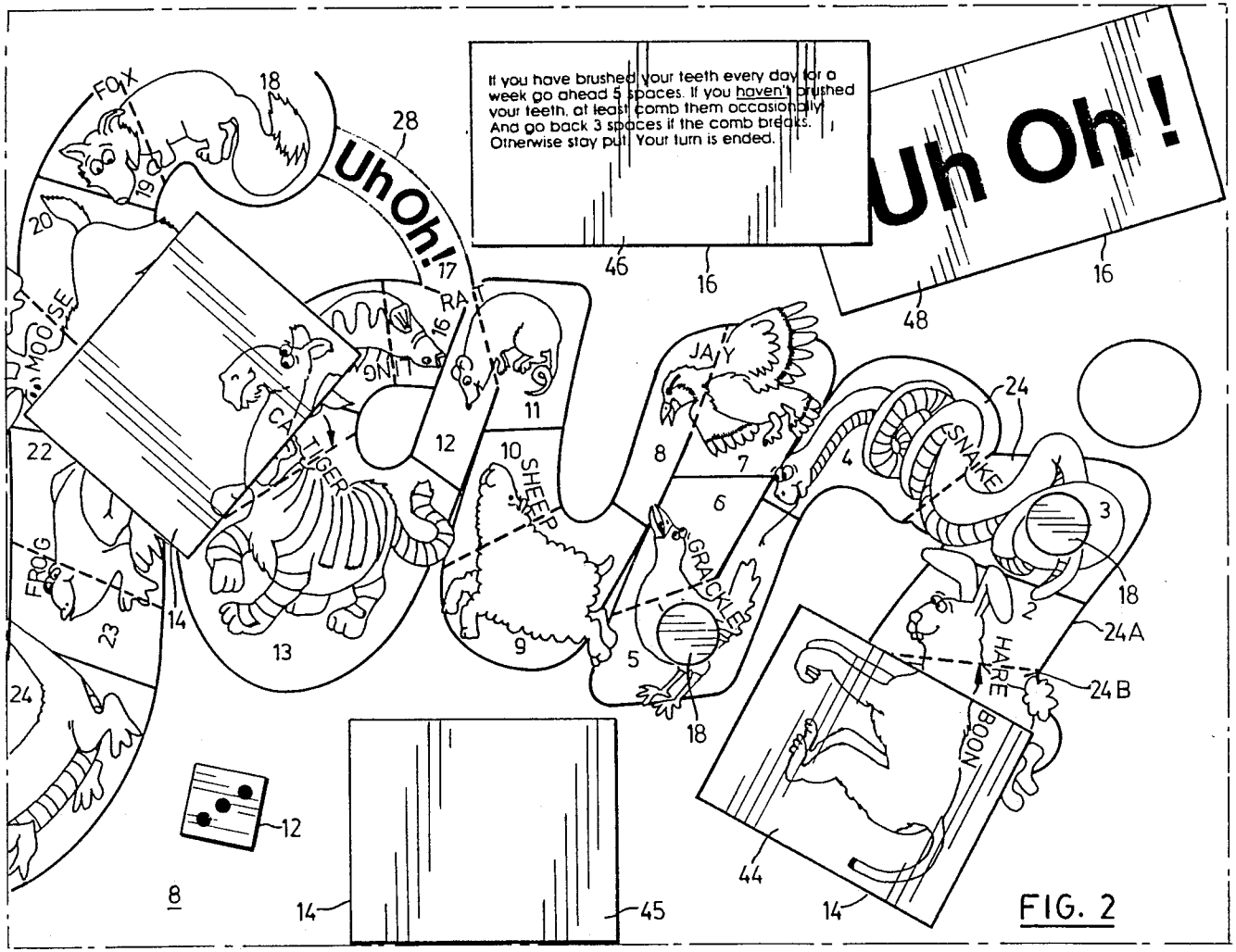
FIG. 2 is an enlarged view of area 2 of the game board of FIG. 1, and also shows playing pieces, tokens and a die for use with the game board.

Referring first to FIG. 1 of the drawings, game playing apparatus in accordance with the preferred embodiment of the present invention includes a playing surface 8 carried by game board 10, and as may be seen in FIG. 2 of the drawings, a die 12, a plurality of first playing pieces in the form of animal cards 14, a plurality of second playing pieces in the form of question or command cards 16 and a plurality of tokens 18.

With reference again to FIG. 1, it can be seen that the game board 10 carries a representation of the words SILLY SAFARI in script 20. The script 20 defines a path 22 along which a game may progress and accordingly is divided into a plurality of spaces 24. As can be seen more clearly in FIG. 2, representations of various creatures 26 (animals, birds, fish, reptiles, insects) are provided along the path 22 and are arranged such that the body and head of each creature 26 falls in a separate adjacent space 24. The name of each creature is printed on the path (see FIG. 2), and is similarly divided into two parts, each in an adjacent space 24. Thus, the majority of the spaces 24 either contain at least the head of a creature or the body of a creature. There are also a number of other spaces 28 (FIG. 2) marked with the words UH OH!, the purpose of which will be explained below. The spaces 24, 28 are numbered consecutively from a first starting space 30 adjacent a start line 31, at the base of the "I" of SAFARI, to the last space 32, adjacent a finish line 33, at the beginning of the "S" of SILLY.

The board 10 is conveniently formed of stiff card coated on the base and sides with flexible finishing paper 34, and on the upper face with paper 36 printed with the game board representation 36. To allow the game board 10 to be folded down for storage, the sides 38, 40 of the board are formed of separate pieces of card held together by paper 34, 36. The sides 38, 40 are also cut in half along a center line 42, the left side (as seen in FIG. 1) being cut all the way through, and the right side 40 only being cut through to the sufficient depth to allow the side 40 to be folded.

The animal cards 14 are formed of rectangular sheets of thin card and each carries, on a front side 44, a representation of the head or body of a creature corresponding to the representation contained in one of the spaces 24 on the path 22. The reverse sides 45 of the cards 14 are of plain, like appearance. As fifty-six different creatures are represented on the board 10 (not all shown), and each creature is divided into a head part and a body part, there are one hundred and twelve creature spaces and therefore one hundred and twelve animal cards. Each card also includes the portion of the name of the creature, corresponding to the letters printed in each space 24 on the path 22.

The tokens 18 are in the form of four sets of ten plastic discs, each set a different colour.

The question or command cards 16 each have a front side 46 carrying a question, an answer and an action to be taken which may depend on the answer given to the question or simply a command. The card may also carry some information or a joke. The reverse side 48 of each card 18 is of like appearance and carries the words UH OH!

To play the game, the game board 10 is opened and the question cards 16 shuffled and placed reverse side uppermost on the space 50 (FIG. 1) provided on the board 10. Each one of the two to four players selects a colour of token 18 and rolls the die 12, with the player rolling the highest score starting first. In the event of a tie, the die is rolled until a winner is decided. The animal cards 14 are also shuffled and placed face down in a separate pile.

In the standard version of the game, each player begins their first turn by taking one animal card 14. Each card will show either a head piece or a body. A player rolls the die 12 and moves the number of spaces shown on the die, moving consecutively from the starting space 30. If the player's animal card 14 shows a head and the player lands on a head space 24A, or alternatively, the player's animal card shows a body and the player lands on a body space 24B immediately the player must read out loud name of the creature created by combining the lettering on the player's animal card and the lettering on the other half of the creature which the card is now partially covering. If a player forgets to do so, their turn is ended, and no trophy is won for that move.

Where a player creates a new creature, or even a known creature, in this way, the player is credited with having created a new creature and therefore wins a trophy, in the form of the animal card. The player takes a new animal card, placing it on the board where the previous animal card was positioned and the player's turn continues.

If the player's animal card shows a body and the player lands on a head space 24A, or alternatively, the player has a head card and lands on a body space 24B, no new creature is created and in normal circumstances, the turn is ended. However, if the player's animal card lettering can be combined with the lettering on either the space ahead or the space behind to create a dictionary word, the player moves ahead one space. This move will create a new creature and win a trophy, unless the next space is an UH OH! space.

A player landing on an UH OH! space will have the top card from the UH OH! pile 50 read to him by an opposing player and will try to answer any questions or follow any instructions on that card. On completing these instructions, the player's turn has ended and no trophy is won, unless the UH OH! card instructs otherwise. The UH OH! card is replaced at the bottom of the pile.

In this particular example, the body space of the squirrel (not shown) is designated as a special space. The space also contains the letters REL of the word squirrel. A player landing on the body space continues play, even with the head card, because any word starting with SQUIR is judged to be a real word as it is bound to be amusing. The player does not win a trophy, but keeps the same animal card and rolls the die again.

On a turn ending, the player marks the space with a token 18 and retains the animal card 14 for the next turn.

If a player lands on or picks the same animal card corresponding to the space the player is on at that moment, the player wins not only a trophy, but also gets a five point bonus. This is counted by taking five tokens 18.

In the event of a head and body combination of animal card and playing space also making a dictionary word, in addition to a new or real creature, the player wins one bonus point in addition to winning a trophy. If, for example, a player playing with DI (head space of DI/NO) lands on KI (head spce of KI/D), the word DID woudl be created. The player is therefore entitled to take a token 18.

To finish the game, a player must roll the correct number on the die to cross the finishing line 33. The game is finished when the first player crosses the finish line, and the winner is found by calculating the number of points each player has scored, the highest number of points winning the game. Each trophy counts as one point, but a complete trophy, that is the head and body of the same creature, counts as three points. The animal cards which were still being used as playing pieces may not be counted towards the final score, other than by the player who crossed the finish line first.

If a slightly more demanding game is required, a more advanced set of rules may be followed. As in the standard version, a player with a head card landing on a head space (or a body card on a body space) can continue the turn by making a real word. In the advanced version, the player may move ahead one space if they can create a dictionary word by combining the portion of the word on the animal card with the portion of a word on one of the adjoining spaces by (1) changing one letter in either space or (2) adding one letter in either space. For example, if a player using the body card for the HA/RE, carrying the letters RE, lands on the head space of SNA/KE. No new creature is made, but the lettering shows RE/KE. The player changes the first E to A to make RAKE, a dictionary word, and therefore advances one space. Further, if a player using TE, on body card from KI/TE, lands on the head of the MO/TH, the lettering shows TE/TH. The player may add E to make TEETH, and therefore advance one space. This move will create a new creature and win a trophy, unless the next space is an UH OH! space.

Players must agree at the start of the game how long one gets to create a word. If this time runs out, the player's turn is ended.

In a further advanced version, the other players may also take part in the creation of a dictionary word, in competition with the player whose turn it is, as in the advanced version. A player with a head card landing on a body space (or with a body card and landing on a head space) will immediately try to make a word. However, if another player can make a word quicker than the actual player, the challenger wins the animal card in play as a trophy and the challenged player's turn ends. The challenged player picks a new animal card to replace the one which was lost, and waits for the next turn, placing a token where the challenge occurred. If, however, the challenger is wrong, and makes a word which cannot be found in a dictionary or is incorrectly spelled, the challenged player may pick one of the challenger's trophies. If the challenger does not have any trophies at this point, the first trophy won will be given to the challenged player.

To challenge a player, the challenger must say, "I challenge" and give the new word immediately, any hesitation leading to a failed challenge. A successful challenger does not move on the board, but waits for a regular turn.

If more than four people are present, teams may be formed to play the game, particularly when playing the further advanced version, where the different team member's attention and interest is maintained by the continuous challenge of forming words.

Thus, it will be seen that the game apparatus provides an enjoyable game which may be played by children, or in teams consisting of adults and children. Younger children, who are unable to read, will enjoy making funny animals and will learn to identify the creatures shown on the board and cards. Older children will also benefit from making up new words, and from answering the questions posed by the question cards.

In a game dedicated for younger children, only the representations of the creatures need be shown on the board, the player's turns continuing only when a creature is created.

It will be clear that games of this form need not be limited to representations of creatures, and may for example, show representations and names of automobiles, or indeed any objects of interest. In such a case, the question cards would carry questions relating to the objects shown on the board.

I claim:

1. Game playing apparatus comprising:

a playing surface including a representation of a path comprising a plurality of discrete spaces arranged sequentially along the path, and for each of a plurality of the discrete spaces, a representation of a first portion of a respective object which is divided into first and second portions; and a set of playing pieces, each bearing on a front side thereof, a representation of one of said second portions of an object, and adapted for advancement along the path whereby, when the playing piece is placed on a space adjacent a space bearing the first portion of an object, a complete object is formed from these first and second portions.

2. Game playing apparatus comprising:

a playing surface including a representation of a path divided into a chain of discrete spaces and representations of different objects overlying the path, each object extending between respective first and second adjacent spaces such that each object is divided into respective first and second portions; and a set of playing pieces, each bearing, on a front side thereof, a representation of one of the first and second portions of an object, and adapted for advancement along the path whereby, when the playing piece is placed on a space adjacent a space bearing the other of the first and second portions of an object, a complete object is formed from those first and second portions.

3. Game playing apparatus as claimed in claim 2, in which the playing surface includes a plurality of words associated one with each of the different objects and also overlying the path, each word extending between said respective first and second spaces such that each object and associated word are divided into respective first and second portions, and the playing pieces each bearing a representation of one of a said respective first and second portion of an object and associated word corresponding to one of said first and second portions on the playing surface.

4. Game playing apparatus as claimed in claim 1, 2 or 3, and further comprising die means for generating a number to determine the number of spaces a player will move a playing piece along the path.

5. Game playing apparatus as claimed in claim 1, 2 or 3, and further comprising a board bearing the playing surface.

6. Game playing apparatus as claimed in claim 1, 2 or 3, in which the playing pieces are of like shape having front and reverse sides, said reverse sides each being of a first like appearance.

7. Game playing apparatus as claimed in claim 1, 2 or 3, and further comprising a number of question or command spaces provided on the path, and a set of question or command playing pieces, each bearing either a question to be answered by a player landing on a question space and an action to be taken by the player depending on the answer given to the question, or a simple command.

8. Game playing apparatus as claimed in claim 1, 2 or 3, and further comprising a number of question or command spaces provided on the path, and a set of question or command pieces of like shape having front and reverse sides, said reverse sides each being of a first like appearance, and said front sides each bearing either a question to be answered by a person landing on a question space and an action to be taken by the player depending on the answer given to the question, or a simple command.

9. Game apparatus as claimed in claim 1, 2 or 3, in which tokens are provided to be collected by players scoring points during the course of a game.

10. Game apparatus as claimed in claim 1, 2 or 3, in which the objects represented on the playing surface and playing pieces are creatures.

11. Game apparatus as claimed in claim 3, in which the objects represented on the playing surface and playing pieces are creatures and the associated words are the names of the creatures.

12. Game apparatus as claimed in claim 1, 2 or 3, in which 56 different objects are represented on the playing surface.

13. Game playing apparatus comprising:

a playing surface including a representation of a path divided into a chain of discrete spaces and representations of different creatures overlying the path, each creature extending between respective first and second adjacent spaces such that each creature is divided into respective head and body portions; and a set of playing pieces each bearing a representation of one of the head and body portions and adapted for advancement along the path, whereby, when the playing piece is placed on a space adjacent a space bearing the other of the first and second portions of an object, a complete object is formed from those first and second portions.

14. Game playing apparatus as claimed in claim 13, in which the playing surface includes a plurality of creature's names associated one with each of the different creatures and also overlying the path, each name extending between said respective first and second spaces such that each creature and creature's name are divided into respective head and body portions of a creature and creature's name corresponding to one of said head and body portions on the playing surface.

15. Game playing apparatus as claimed in claim 14, and further comprising die means for generating a number to determine the number of spaces a player will move a playing piece along the path.

16. Game playing apparatus as claimed in claim 13 or 14, and further comprising a board bearing the playing surface.

17. Game playing apparatus as claimed in claim 13 or 14, in which the playing pieces are of like shape having front and reverse sides, said reverse sides each being of a first like appearance.

18. Game playing apparatus as claimed in claim 13 or 14, and further comprising a number of question or command spaces provided on the path, and a set of question or command playing pieces, each bearing either a question to be answered by a player landing on a question space and an action to be taken by the player depending on the answer given to the question, or a simple command.

19. Game playing apparatus as claimed in claim 13 or 14, and further comprising a number of question or command spaces provided on the path, and a set of question or command pieces of like shape having front and reverse sides, said reverse sides each being of a first like appearance, and said front sides each bearing either a question to be answered by a person landing on a question space and an action to be taken by the player depending on the answer given to the question, or a simple command.

20. Game apparatus as claimed in claim 13, or 14, in which tokens are provided to be collected by players scoring points during the course of a game.

21. Game apparatus as claimed in claim 13, or 14, in which 56 different creatures are represented on the playing surface.

* * * * *